US007926740B2

(12) United States Patent
Parris et al.

(10) Patent No.: US 7,926,740 B2
(45) Date of Patent: Apr. 19, 2011

(54) PRESSURE WASHER SYSTEM AND OPERATING METHOD

(75) Inventors: Gregory L. Parris, Jackson, TN (US); Daniel W. Rice, Jackson, TN (US); Joseph L. Jenkins, Jr., Jackson, TN (US)

(73) Assignee: Black & Decker Inc., Newark, DE (US)

( * ) Notice: Subject to any disclaimer, the term of this patent is extended or adjusted under 35 U.S.C. 154(b) by 117 days.

(21) Appl. No.: 12/043,377

(22) Filed: Mar. 6, 2008

(65) Prior Publication Data

US 2008/0245899 A1 Oct. 9, 2008

Related U.S. Application Data

(60) Provisional application No. 60/910,145, filed on Apr. 4, 2007.

(51) Int. Cl.
*B05B 9/03* (2006.01)

(52) U.S. Cl. ..... 239/146; 239/390; 239/525; 239/332; 239/337; 417/34; 417/43; 417/364

(58) Field of Classification Search ..... 239/146, 239/526, 390, 397, 398, 391, 332, 129, 127, 239/337, 158, 525, 754; 417/34, 43, 364
See application file for complete search history.

(56) References Cited

U.S. PATENT DOCUMENTS 2,132,721 A * 10/1938 Clarke ..... 477/88
4,051,814 A 10/1977 Jennings
4,336,627 A 6/1982 Bascus
4,341,017 A 7/1982 Janczak
4,913,345 A * 4/1990 Setter ..... 239/127
4,981,178 A * 1/1991 Bundy ..... 169/9
5,009,547 A * 4/1991 Clark ..... 404/112
5,035,580 A 7/1991 Simonette
5,228,842 A 7/1993 Guebeli et al.
5,282,722 A 2/1994 Beatty
(Continued)

FOREIGN PATENT DOCUMENTS

DE 198 38 947 11/1999
(Continued)

OTHER PUBLICATIONS

Cat Pumps—System Saver Throttle Controller Model 8100.
(Continued)

*Primary Examiner* — Dinh Q Nguyen
*Assistant Examiner* — Trevor E McGraw
(74) *Attorney, Agent, or Firm* — Harness, Dickey & Pierce, P.L.C.

(57) ABSTRACT

A pressure washer is provided. The pressure washer can include a frame and a power source coupled to the frame. The power source can include an output shaft. The pressure washer can include a centrifugal clutch. The centrifugal clutch can include an input portion operably coupled to the output shaft and an output portion. The input portion of the centrifugal clutch can be operable to be selectively coupled to the output portion. The pressure washer can include a pump assembly, which can include a pump mechanism operably coupled with the output portion of the centrifugal clutch to pressurize a fluid when the input portion of the centrifugal clutch is coupled to the output portion. The pressure washer can also include an actuator in communication with at least the power source to actuate the power source to drive the output shaft.

13 Claims, 3 Drawing Sheets

U.S. PATENT DOCUMENTS

| | | | | |
|---|---|---|---|---|
| 5,346,370 | A | 9/1994 | Krohn | |
| 5,421,520 | A * | 6/1995 | Simonette et al. | 239/525 |
| 5,435,697 | A | 7/1995 | Guebeli et al. | |
| 5,462,764 | A | 10/1995 | Jones et al. | |
| 5,468,293 | A | 11/1995 | Jones et al. | |
| 5,520,253 | A * | 5/1996 | Kesting | 172/125 |
| 5,605,105 | A | 2/1997 | Clark et al. | |
| 5,718,255 | A | 2/1998 | Gilpatrick et al. | |
| 5,848,877 | A * | 12/1998 | Dill et al. | 417/44.2 |
| 5,902,094 | A * | 5/1999 | Hoenisch et al. | 417/26 |
| 6,031,352 | A | 2/2000 | Carlson | |
| 6,092,998 | A | 7/2000 | Dexter et al. | |
| 6,397,729 | B1 | 6/2002 | Dexter et al. | |
| 6,398,134 | B1 | 6/2002 | Hickson et al. | |
| 6,431,844 | B1 | 8/2002 | Dexter et al. | |
| 6,455,017 | B1 * | 9/2002 | Kasting et al. | 422/292 |
| 6,467,394 | B1 | 10/2002 | Wood et al. | |
| 6,648,603 | B2 * | 11/2003 | Dexter et al. | 417/34 |
| 6,779,987 | B2 | 8/2004 | Dexter et al. | |
| 6,866,486 | B2 | 3/2005 | Dexter et al. | |
| 6,892,957 | B2 | 5/2005 | Bennett et al. | |
| 6,929,198 | B2 | 8/2005 | Dexter | |
| 7,114,664 | B2 * | 10/2006 | Gundersen et al. | 239/149 |
| 7,125,228 | B2 | 10/2006 | Dexter et al. | |
| 2006/0038034 | A1 * | 2/2006 | Hillary | 239/146 |
| 2006/0245941 | A1 | 11/2006 | Sharp | |
| 2007/0051834 | A1 | 3/2007 | Dexter et al. | |
| 2007/0063066 | A1 * | 3/2007 | Vijay et al. | 239/99 |
| 2007/0177989 | A1 | 8/2007 | Koka et al. | |
| 2007/0296223 | A1 * | 12/2007 | Saylor | 290/1 R |
| 2008/0001007 | A1 * | 1/2008 | Gilpatrick et al. | 239/310 |

FOREIGN PATENT DOCUMENTS

| | | |
|---|---|---|
| JP | 09-057164 | 3/1997 |
| JP | 2004-136165 | 5/2004 |
| JP | 2005-299519 | 10/2005 |

OTHER PUBLICATIONS

Comet Industries—OEM for Manufacturers—Centrifugal Clutches.
BLM Centrifugal Solutions—Coupling Style Clutches.
BLM/Centri-Matic—Automatic Centrifugal Clutches.

* cited by examiner

PRESSURE WASHER SYSTEM AND OPERATING METHOD

CROSS-REFERENCE TO RELATED APPLICATION

This application takes priority from U.S. Patent Application No. 60/910,145 filed Apr. 4, 2007. The disclosure of the above application is incorporated herein by reference.

INTRODUCTION

The present disclosure generally relates to pressure washers. More particularly, the present disclosure relates to a pressure washer having a clutch disposed between a power source and a high pressure pump and a related method for operating a pressure washer.

Generally, high pressure washing systems, commonly referred to as pressure washers, can operate to deliver a high pressure fluid, such as water, to a desired surface. The high pressure fluid can be used to clean, strip or prepare the surface for other treatment. Pressure washers can be produced in a variety of designs and can be used to perform numerous functions in industrial, commercial and home applications. Pressure washers can be stationary or portable. Generally, stationary pressure washers can be used in industrial or commercial applications, such as car washes or the like. Portable pressure washers can include a power source and a pump that can be carried or wheeled from place to place.

Typically, the pump employed by pressure washers can be a piston pump having one or more reciprocating pistons for delivering liquid under pressure to an outlet or a device coupled to the outlet, such as a high-pressure spray wand. Such piston pumps often utilize two or more pistons to provide a generally more continuous spray, higher flow rate, and greater efficiency. Multiple piston pumps can employ articulated pistons (utilizing a journal bearing and wrist pins) or may utilize a swash plate and linear pistons for pumping the liquid. Generally, when the pump is activated by the power source, the pump remains active for the duration of the use of the pressure washer. This can result in increased wear on the pump, and thus can wear a motor coupled to the pump. Accordingly, it would be desirable to provide a pressure washer that includes a clutch to engage and disengage the pump during the operation of the pressure washer.

Provided is a pressure washer. The pressure washer can include a frame and a power source coupled to the frame. The power source can include an output shaft. The pressure washer can include a centrifugal clutch. The centrifugal clutch can include an input portion operably coupled to the output shaft and an output portion. The input portion of the centrifugal clutch can be operable to be selectively coupled to the output portion. The pressure washer can include a pump assembly, which can include a pump mechanism operably coupled with the output portion of the centrifugal clutch to pressurize a fluid when the input portion of the centrifugal clutch is coupled to the output portion. The pressure washer can also include an actuator in communication with at least the power source to actuate the power source to drive the output shaft.

Further provided is a pressure washer. The pressure washer can include a frame and a pump assembly coupled to the frame. The pump assembly can include a pump mechanism that pressurizes a fluid. The pressure washer can also include a power source in communication with the pump mechanism to selectively drive the pump mechanism to pressurize the fluid. The pressure washer can include a manifold in fluid communication with the pump mechanism. The manifold can include an inlet that receives fluid at a first pressure, an outlet that outputs fluid at a second pressure, a first pressure line fluidly coupled to the pump mechanism, and a second pressure line. The pressure washer can include an actuator in fluid communication with the second pressure line and in communication with the power source to drive the pump mechanism based on a pressure differential between the first pressure line and the second pressure line.

Also provided is a pressure washer. The pressure washer can include a frame and an engine coupled to the frame. The engine can include an output shaft and a throttle control that controls a speed of the output shaft. The pressure washer can include a centrifugal clutch. The centrifugal clutch can include an input portion operably coupled to the output shaft and an output portion. The input portion of the centrifugal clutch can be operable to be selectively coupled to the output portion based on the speed of the output shaft. The pressure washer can include a pump assembly supported by the frame. The pressure washer can include a pump mechanism operably coupled with the output portion of the centrifugal clutch to pressurize a fluid when the input portion of the centrifugal clutch is coupled to the output portion. The pressure washer can include a manifold in fluid communication with the pump mechanism. The manifold can include an inlet that receives fluid at a first pressure, an outlet that outputs fluid at a second pressure, a first pressure line fluidly coupled to the pump mechanism, and a second pressure line. The pressure washer can also include a sprayer system in fluid communication with the second pressure line and the outlet. The sprayer system can include a trigger adapted to be actuated by a user between a first, closed position and a second, opened position. The pressure washer can include an actuator operably coupled to the throttle control. The actuator can be in fluid communication with the first pressure line and the second pressure line to increase or decrease the speed of the output shaft based on a pressure differential between the first pressure line and the second pressure line. The actuation of the trigger between the first, closed position and the second, opened position creates a pressure differential between the first pressure line and the second pressure line.

Further areas of applicability of the present teachings will become apparent from the detailed description provided hereinafter. It should be understood that the detailed description and specific examples, while indicating various embodiments of the present teachings, are intended for purposes of illustration only and are not intended to limit the scope of the present teachings.

BRIEF DESCRIPTION OF THE DRAWINGS

The present disclosure will become more fully understood from the detailed description and the accompanying drawings, wherein.

DESCRIPTION OF THE VARIOUS EMBODIMENTS

Figure 1:
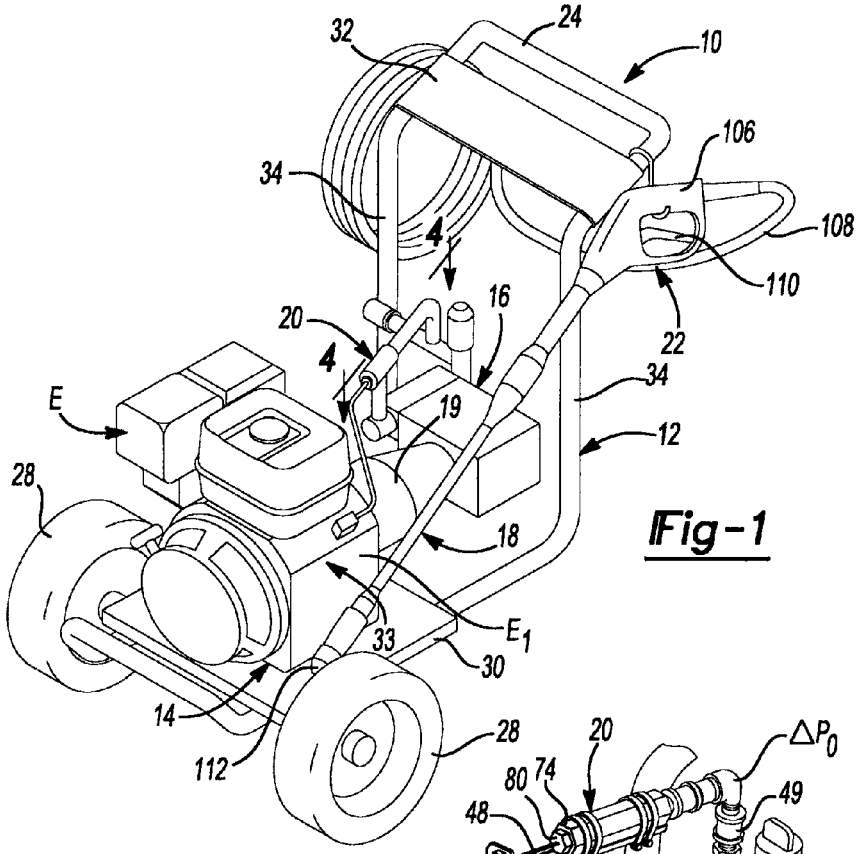
FIG. 1 is a perspective view of an exemplary pressure washer with a clutch according to various teachings.
Figure 2:
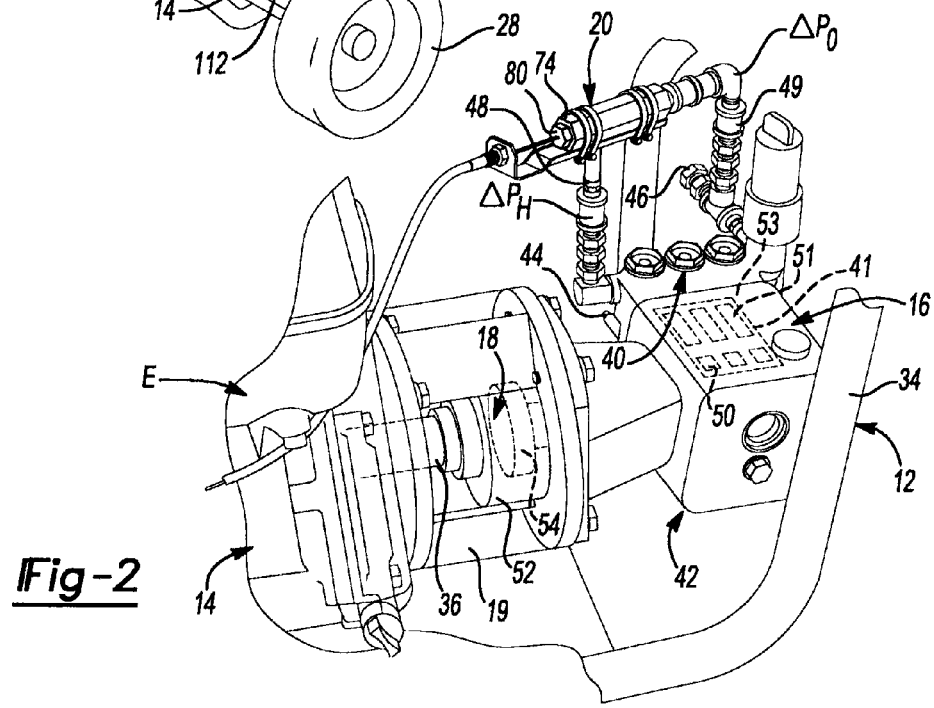
FIG. 2 is a detailed perspective view of the clutch and an actuator for use with the pressure washer of FIG. 1.

With reference to FIGS. 1 and 2 of the drawings, an exemplary pressure washer constructed in accordance with the teachings of the present disclosure is generally indicated by reference numeral 10. The pressure washer 10 can include a frame 12, a power source 14, a pump assembly 16, a clutch 18, a guard or support 19, which is disposed about the clutch 18 and coupled to the power source 14 and the pump assembly 16, an actuator system 20 and a sprayer system 22 for delivering the high pressure fluid.

The frame 12 can be constructed in any convenient manner to support the power source 14, such as that which is described in U.S. Pat. No. 7,125,228, entitled "Pressure Washer Having Oilless High Pressure Pump", the disclosure of which is incorporated by reference as if set forth in its entirety herein. Accordingly, the frame 12 need not be discussed in significant detail herein. Briefly, the frame 12 can include a handle 24, one or more wheels 28, and a body 30. The handle 24 can include a cross-rail 32 supported on a pair of arms 34. The cross-rail 32 can support for the sprayer system 22 when the sprayer system 22 is not in use.

The power source 14 can be any type of device for providing an output to drive the pump assembly 16, such as an electric motor or an internal combustion engine. In the particular example provided, the power source 14 is an internal combustion engine E, such as a 13 hp horizontal shaft four-cycle engine of the type that is commercially available from a variety of sources. As such internal combustion engines are well known in the pressure washer art, a discussion of the internal combustion engine need not be provided herein. It will be appreciated that the internal combustion engine E include a cylinder block E1, which can be mounted on the body 30 of the frame 12, a throttle control 33 and an output shaft 36 (FIG. 2).

Figure 3:
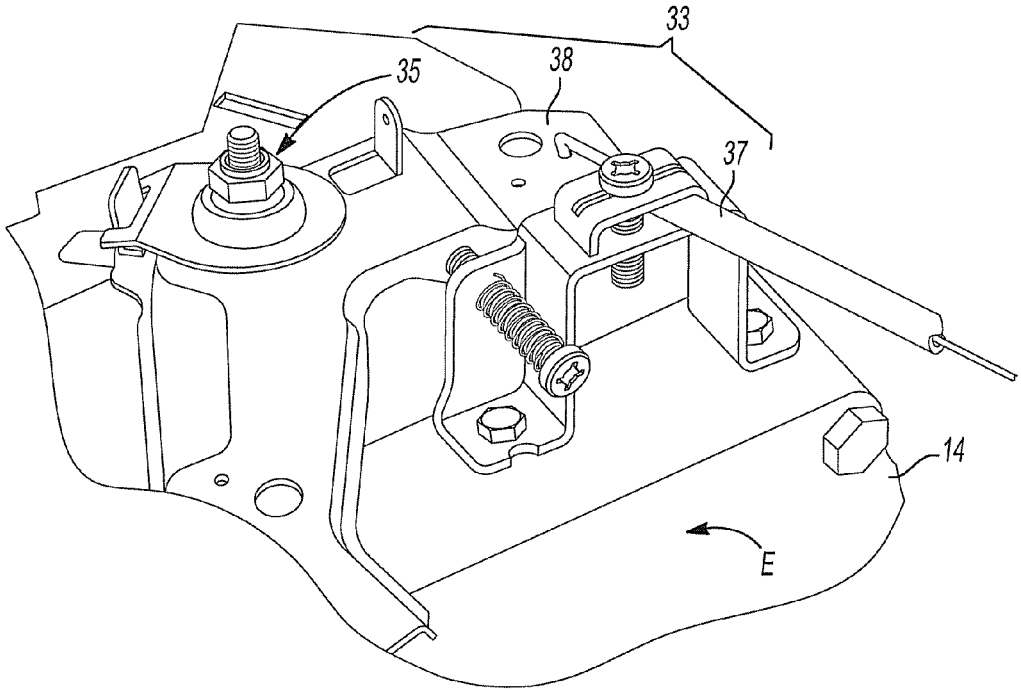
FIG. 3 is a detailed perspective view of an exemplary throttle control for use with the pressure washer of FIG. 1.

With reference to FIGS. 2 and 3, the throttle control 33 can be employed to control the amount of fresh air that is input to the internal combustion engine E. As the amount of fuel that is provided to the internal combustion engine E for combustion is normally related to the amount of air that is input to the internal combustion engine E, the throttle control 33 can indirectly control the speed of the internal combustion engine E. With reference to FIG. 3, the throttle control 33 can include a throttle 35 and a throttle cable 37. The throttle 35 can be constructed in a well known manner and can include a throttle lever 38 and a throttle plate (not shown) that is coupled for rotation to the throttle lever 38. Rotation of the throttle lever 38 can cause likewise rotation of the throttle plate to thereby reduce or increase the size of an opening through which air is admitted into the internal combustion engine E (e.g., via a carburetor (not shown)). The throttle cable 37 can couple the throttle lever 38 to the actuator system 20 to control the throttle plate, as will be discussed in detail below. Briefly, however, the throttle cable 37 can be displaced in a first direction by the actuator system 20 to pivot the throttle plate into a substantially open or full throttle position, which permits a maximum amount of air to be admitted to the internal combustion engine E, and the throttle cable 37 can be displaced in a second direction (opposite the first direction) by the actuator system 20 to pivot the throttle plate into a substantially closed or idle position, which permits a minimum amount of air to be admitted to the internal combustion engine E. It will be appreciated that for a given load, the internal combustion engine E will generally operate at its fastest speed when the throttle plate is positioned at or proximate the full throttle position and will generally operate at its slowest speed when the throttle plate is positioned at or proximate the idle position.

Returning to FIG. 2, the clutch 18 can be any type of clutch for selectively coupling the output shaft 36 of the internal combustion engine E to the pump assembly 16. In the particular example provided, the clutch 18 is a commercially available centrifugal clutch of the type that is manufactured by BLM Automatic Clutch Ltd. of Toronto, Canada. The clutch 18 can generally include an input portion 52 and an output portion 54. The input portion 52 can be coupled for rotation with the output shaft 36 of the internal combustion engine E and can include a mechanism, such as friction shoes (not shown) that can move radially outwardly in response to the centrifugal force acting on the friction shoes to cause the friction shoes to drivingly engage the output portion 54. It will be appreciated that the friction shoes move radially inwardly when the rotational speed of the input portion 52 is at or below a predetermined rotational speed to thereby de-couple the output portion 54 from the input portion 52 and permit relative rotation between the input and output portions 52 and 54.

The pump assembly 16 can be any type of pump, such as an axial piston pump of the types that are disclosed in the above-mentioned U.S. Pat. No. 7,125,228 or U.S. Pat. No. 6,0132,998, entitled "Pump For A Pressure Washer," the disclosure of which is incorporated by reference as if set forth in its entirety herein. In the particular example provided, the pump assembly 16 is an axial piston pump and includes a pump body 42, a pump head or manifold 40 and a pump mechanism 41 that can include one or more pistons 51 and one or more eccentrics 50. Each of the pistons 51 can be disposed in a piston chamber 53 that can be formed in the pump body 42 and/or the manifold. The eccentric(s) 50 can be coupled for rotation with the output portion 54 of the clutch 18. The eccentric(s) 50 can be employed to cause the piston(s) 51 to reciprocate in the piston chamber(s) 53 when the input and output portions 52 and 54 of the clutch 18 are coupled for rotation with one another to thereby pressurize the fluid that is disposed in the piston chamber(s) 53. A bypass valve (not shown) can be coupled in fluid connection to the piston chamber(s) 53 and can inhibit the build-up of excess fluid pressure in the piston chamber(s) 53 when the piston(s) 51 is/are reciprocating but the sprayer system 22 is not activated to discharge the high pressure fluid that is output from the high pressure outlet 46.

The manifold 40 can be coupled to the pump housing 42 and can coordinate the routing of low and high pressure fluids in the pump assembly 16. The manifold 40 can include a low pressure inlet 44, a high pressure outlet 46, a head pressure line 48 and an outlet pressure line 49. The low pressure inlet 44 can be coupled to a fluid supply (not shown) to provide low pressure fluid to the piston chamber(s) 53. The low pressure inlet 44 can be coupled in fluid communication with a check valve (not shown) to prevent fluid from exiting the pump body 42. The high pressure outlet 46 can be coupled in fluid communication to the sprayer system 22 to facilitate the delivery of high pressure fluid to the sprayer system 22. The head pressure line 48 can couple the piston chamber(s) 53 in fluid communication with the actuator system 20 such that a head pressure $P_H$ (i.e., a pressure of the fluid exiting the pump housing) is exerted to the actuator system 20 as will be described in detail, below. The outlet pressure line 49 can be in fluid communication with the actuator system 20 to apply an outlet pressure $P_O$ to the actuator system 20 as will be discussed in detail, below.

Returning to FIG. 1, the sprayer system 22 can be conventional in its construction and operation and can include a wand 106 and a hose 108 that couples the high pressure outlet 46 and the wand 106 in fluid communication. It will be appreciated that the wand 106 includes a conventional trigger valve 110 that controls the discharge of high pressure fluid from the wand 106. In this regard, the valve 110 is a normally closed valve that can be manually opened by an operator of the pressure washer.

Figure 4:
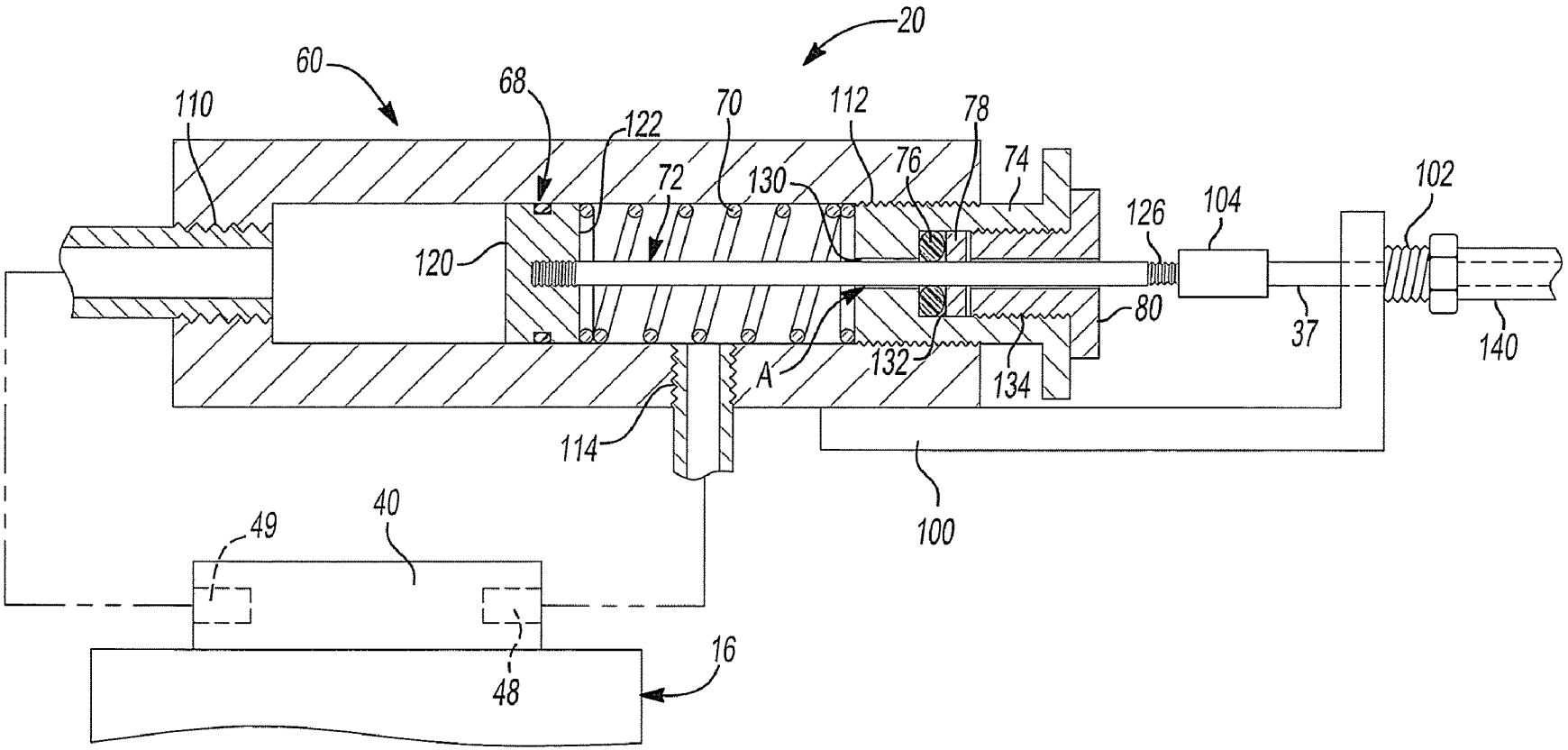
FIG. 4 is a cross-sectional view of the actuator system of the pressure washer taken along line 4-4 of FIG. 1.

With reference to FIGS. 2 and 4, the actuator system 20 can be configured to sense a pressure differential between the head pressure line 48 and the outlet pressure line 49 and responsively adjust the throttle lever 38. In the particular example provided, the actuator system 20 includes a cylinder housing 60, a piston 68, a rod 72, an outer bushing 74, an inner bushing 80, a plurality of seal members 76, 78, a spring 70, a bracket 100, a cable mount 102 and a cable connector 104.

The cylinder housing 60 can be a tubular member having a first threaded opening 110, a second threaded opening 112 and a third threaded opening 114 that can be disposed between the first and second threaded openings 110 and 112. Conventional fluid conduit elements (e.g., nipples, elbows) can be employed to fluidly couple the first threaded opening 110 to the outlet pressure line 49 in the manifold 40. Conventional fluid conduit elements (e.g., nipples, elbows) can be employed to fluidly couple the third threaded opening 114 to the head pressure line 48 in the manifold 40.

The piston 68 can be disposed in the cylinder housing 60 between the first and third threaded openings 110 and 114. Accordingly, a first face 120 of the piston 68 is exposed to the head pressure $P_H$ and a second face 122 of the piston 68 is exposed to the outlet pressure $P_O$. The rod 72 is coupled to the piston 68 and extends through the second threaded opening 112 in the cylinder housing 60. An end 126 of the rod 72 opposite the piston 68 can be threaded to facilitate connection of the rod 72 to the throttle cable 37.

The outer bushing 74 can be threaded into the second threaded opening 112 and can define an aperture A with a through bore 130 and a seal pocket 132 that can include a female threaded portion 134. The rod 72 can be received through the through aperture A. The seals 76 and 78 can be received in the seal pocket 132 and can sealingly engage the inner diameter of the seal pocket 132 and the outer diameter of the rod 72. The inner bushing 80 can threadably engage the female threaded portion 134 of the outer bushing 74 and can abut the seal 78. It will be appreciated that the outer and inner bushings 74 and 80 and the seals 76 and 78 cooperate permit the rod 72 to slide relative to the cylinder housing 60 without permitting fluid within the cylinder housing 60 to leak. It will also be appreciated that the outer and inner bushings 74 and 80 and the seals 76 and 78 form a "packing" and that the packing can be tightened by threading the inner bushing 80 into the outer bushing 74.

The spring 70 can be disposed between the outer bushing 74 and the second face 122 of the piston 68 and can bias the piston 68 toward the first threaded opening 110 in the cylinder housing 60.

The bracket 100 can be employed to couple the cable mount 102 to the cylinder housing 60 in a stationary manner. The cable mount 102 can be coupled to a protective sheath 140 that surrounds the throttle cable 37. The cable connector 104 couples the throttle cable 37 to the threaded end 126 of the rod 72. Accordingly, translation of the rod 72 causes likewise movement of the throttle cable 37.

When fluid is not being discharged from the wand 106 (FIG. 1), the outlet pressure $P_O$ is greater than the head pressure $P_H$ due to the bypass valve in the pump assembly 16. As noted above, the bypass valve inhibits the build-up of excess fluid pressure in the piston chamber(s) 53 when the piston(s) 51 is/are reciprocating and the sprayer system 22 is not activated to discharge the high pressure fluid that is output from the high pressure outlet 46. In this condition, the force exerted on the first face 120 of the piston 68 exceeds the force that is exerted on the second face 122 of the piston 68. Accordingly, the piston 68 moves in the cylinder housing 60 toward the outer bushing 74 and compresses the spring 70 until the forces acting on the opposite faces of the piston 68 are in equilibrium. It will be appreciated that movement of the piston 68 in this manner causes likewise movement of the rod 72, which in turn causes a corresponding movement of the throttle cable 37. In response, the throttle lever 38 (FIG. 3) is moved by the throttle cable 37 to cause the throttle plate to move to a position that permits relatively less air to be admitted into the internal combustion engine E, such as the idle position. In turn, the internal combustion engine E will rotate the output shaft 36 at a speed below that which is necessary to cause the input portion 52 to couple to the output portion 54 of the clutch 18. Accordingly, rotary power is not transmitted from the internal combustion engine E to the pump assembly 16 in this condition.

When the wand 106 (FIG. 1) is operated to discharge high pressure fluid, the head pressure $P_H$ is greater than the outlet pressure $P_O$, and as such, the force exerted on the second face 122 of the piston 68 exceeds the force that is exerted on the first face 120 of the piston 68. Accordingly, the piston 68 moves in the cylinder housing 60 toward the first threaded opening 110. It will be appreciated that movement of the piston 68 in this manner causes likewise movement of the rod 72, which in turn causes a corresponding movement of the throttle cable 37. In response, the throttle lever 38 (FIG. 3) is moved by the throttle cable 37 to cause the throttle plate to move to a position that permits relatively more air to be admitted into the internal combustion engine E (e.g., the full throttle position). In turn, the internal combustion engine E will begin to rotate the output shaft 36 faster, causing the input portion 52 to drive the output portion 54 of the clutch 18 so that rotary power is transmitted from the internal combustion engine E to the pump assembly 16. While fluid is discharged from the wand 106, the pressure differential between the head pressure $P_H$ and the outlet pressure $P_O$ is sufficient to maintain engagement of the clutch 18 (i.e., the internal combustion engine E operates at a sufficient speed so that the input portion 52 of the clutch 18 will be engaged to the output portion 54 of the clutch 18).

It will be appreciated that on start-up or initial use of the pressure washer 10, the pressure of the fluid acting on the first face 120 of the piston 68 will be about equal to the pressure of the fluid acting on the second face 122 of the piston 68. The spring 70, however, applies a force on the second face 122 of the piston 68 that causes the internal combustion engine E to operate at a speed that is sufficiently high so as to cause the input and output portions 52 and 54 of the clutch 18 to engage to permit rotary power to be transmitted to the pump assembly 16.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out this invention, but that the scope of the present disclosure will include any embodiments falling within the foregoing description and the appended claims.

For example, while the pressure washer 10 has been described as including a centrifugal clutch 18 and a mechanical actuator system 20, those of skill in the art will appreciate that the present disclosure, in its broadest aspects, may be constructed somewhat differently. For example, an electronic clutch and electronic actuator system could be employed to actuate the pump assembly 16 and control the power source 14.

What is claimed is:

1. A pressure washer comprising:

a frame;

an engine coupled to the frame, the engine including an output shaft and a throttle control that controls a speed of the output shaft;

a centrifugal clutch including an input portion operably coupled to the output shaft and an output portion, the input portion of the centrifugal clutch operable to be selectively coupled to the output portion;

a pump assembly including a pump mechanism operably coupled with the output portion of the centrifugal clutch to pressurize a fluid when the input portion of the centrifugal clutch is coupled to the output portion;

a manifold in fluid communication with the pump mechanism, the manifold including an inlet that receives fluid at a first pressure, an outlet that outputs fluid at a second pressure, a first pressure line fluidly coupled to the pump mechanism, and a second pressure line;

a sprayer system in fluid communication with the second pressure line and the outlet, the sprayer system including a trigger adapted to be actuated by a user between a first, closed position and a second, opened position; and an actuator operably coupled to at least the engine throttle control and the second pressure line to actuate the engine to drive the output shaft and increase or decrease the speed of the output shaft based on a pressure differential between the first pressure line and the second pressure line;

wherein when the trigger is in the first, closed position, the pressure differential is such that the pressure in the first line is less than the pressure in the second line which causes the actuator to cooperate with the throttle control to operate the engine at an idle condition;

wherein the input portion is selectively decoupled from the output portion such that the pump is selectively decoupled from the engine when the actuator cooperates with the throttle control of the engine to operate the engine at the idle condition.

2. The pressure washer of claim 1, wherein the actuation of the trigger between the first, closed position and the second, opened position creates the pressure differential between the first pressure line and the second pressure line.

3. The pressure washer of claim 1, wherein the manifold receives the fluid directly from a source independent of the pressure washer.

4. The pressure washer of claim 1, wherein the pump is automatically decoupled from the engine when the actuator cooperates with the throttle control of the engine to operate the engine at an idle speed.

5. The pressure washer of claim 1, wherein actuation of the trigger between the first, closed position and the second, opened position causes the pressure differential between the first pressure line and the second pressure line to be such that the pressure in the first line is greater than the pressure in the second line thereby causing the actuator to cooperate with the throttle control to increase the speed of the engine output shaft above the idle condition.

6. A pressure washer comprising:

a frame;

a pump assembly coupled to the frame, the pump assembly including a pump mechanism that pressurizes a fluid;

a power source including an output shaft in communication with the pump mechanism to selectively drive the pump mechanism to pressurize the fluid, and a throttle control that controls a speed of the output shaft;

a manifold in fluid communication with the pump mechanism, the manifold including an inlet that receives fluid at a first pressure directly from a source independent of the pressure washer, an outlet that outputs the fluid at a second pressure, a first pressure line fluidly coupled to the pump mechanism, and a second pressure line;

a sprayer system in fluid communication with the second pressure line and the outlet, the sprayer system including a trigger adapted to be actuated by a user between a first, closed position and a second, opened position; and an actuator operably coupled to the throttle control, and in fluid communication with the first pressure line and the second pressure line increase or decrease a speed of the output shaft based on a pressure differential between the first pressure line and the second pressure line;

wherein when the trigger is in the first, closed position, the pressure differential is such that the pressure in the first line is less than the pressure in the second line which causes the actuator to cooperate with the throttle control to operate the power source at an idle condition.

7. The pressure washer of claim 6, further comprising:

a centrifugal clutch including an input portion operably coupled to the output shaft and an output portion operably coupled to the pump mechanism, the input portion of the centrifugal clutch operable to be coupled to the output portion based on the speed of the output shaft.

8. The pressure washer of claim 6, wherein the actuation of the trigger between the first, closed position and the second, opened position creates the pressure differential between the first pressure line and the second pressure line.

9. The pressure washer of claim 6, wherein the pump is automatically decoupled from the power source when the actuator cooperates with the throttle control to control the power source and the output shaft at an idle speed.

10. The pressure washer of claim 6, wherein actuation of the trigger between the first, closed position and the second, opened position causes the pressure differential between the first pressure line and the second pressure line to be such that the pressure in the first line is greater than the pressure in the second line thereby causing the actuator to cooperate with the throttle control to increase the speed of the engine output shaft above the idle condition.

11. A pressure washer comprising:

a frame;

an engine coupled to the frame, the engine including an output shaft and a throttle control that controls a speed of the output shaft;

a centrifugal clutch including an input portion operably coupled to the output shaft and an output portion, the input portion of the centrifugal clutch operable to be selectively coupled to the output portion based on the speed of the output shaft;

a pump assembly supported by the frame and including a pump mechanism operably coupled with the output portion of the centrifugal clutch to pressurize a fluid when the input portion of the centrifugal clutch is coupled to the output portion;

a manifold in fluid communication with the pump mechanism, the manifold including an inlet that receives fluid at a first pressure, an outlet that outputs fluid at a second pressure, a first pressure line fluidly coupled to the pump mechanism, and a second pressure line;

a sprayer system in fluid communication with the second pressure line and the outlet, the sprayer system including a trigger adapted to be actuated by a user between a first, closed position and a second, opened position;

an actuator operably coupled to the throttle control, and in fluid communication with the first pressure line and the second pressure line to increase or decrease the speed of the output shaft based on a pressure differential between the first pressure line and the second pressure line; and wherein when the trigger is in the first, closed position, the pressure differential is such that the pressure in the first line is less than the pressure in the second line which causes the actuator to cooperate with the throttle control to operate the engine at an idle condition;

wherein the actuation of the trigger between the first, closed position and the second, opened position causes the pressure differential between the first pressure line and the second pressure line to be such that the pressure in the first line is greater than the pressure in the second line thereby causing the actuator to cooperate with the throttle control to increase the speed of the engine output shaft above the idle condition.

12. The pressure washer of claim 11, wherein the manifold receives the fluid directly from a source independent of the pressure washer.

13. The pressure washer of claim 11, wherein the pump is automatically decoupled from the engine when the actuator cooperates with the throttle control to operate the engine at the idle condition.

* * * * *

UNITED STATES PATENT AND TRADEMARK OFFICE

CERTIFICATE OF CORRECTION

PATENT NO. : 7,926,740 B2
APPLICATION NO. : 12/043377
DATED : April 19, 2011
INVENTOR(S) : Gregory L. Parris et al.

It is certified that error appears in the above-identified patent and that said Letters Patent is hereby corrected as shown below:

Column 8,
Line 25, after "line" insert -- to --.

Signed and Sealed this
Seventh Day of June, 2011

David J. Kappos

David J. Kappos
*Director of the United States Patent and Trademark Office*